US010533467B1

(12) United States Patent
Anderson

(10) Patent No.: US 10,533,467 B1
(45) Date of Patent: Jan. 14, 2020

(54) OUTBOARD MOTORS HAVING IDLER-DRIVEN LUBRICATING PUMP

(71) Applicant: Brunswick Corporation, Mettawa, IL (US)

(72) Inventor: Steven Thomas Anderson, Winneconne, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/021,999

(22) Filed: Jun. 28, 2018

(51) Int. Cl.

| | |
|---|---|
| ***F01M 1/02*** | (2006.01) |
| ***F02B 61/04*** | (2006.01) |
| ***F01M 11/00*** | (2006.01) |
| ***F01M 11/04*** | (2006.01) |
| ***F02B 75/22*** | (2006.01) |

(52) U.S. Cl.
CPC ..... *F01M 1/02* (2013.01); *F01M 11/0004* (2013.01); *F01M 11/04* (2013.01); *F02B 61/045* (2013.01); *F01M 2001/0238* (2013.01); *F01M 2001/0253* (2013.01); *F02B 75/22* (2013.01)

(58) Field of Classification Search
CPC ..... F01M 1/02; F01M 11/04; F01M 11/0004; F01M 2001/0253; F01M 2001/0238; F02B 61/045; F02B 75/22
See application file for complete search history.

(56) References Cited

U.S. PATENT DOCUMENTS

| | | | | |
|---|---|---|---|---|
| 4,911,623 | A | 3/1990 | Corbett et al. | |
| 6,138,634 | A | 10/2000 | Kusche et al. | |
| 6,367,442 | B1 * | 4/2002 | Takayanagi | F01L 1/024 123/195 P |
| 6,460,504 | B1 | 10/2002 | Phillips et al. | |
| 6,564,905 | B1 | 5/2003 | Yukioka | |
| 9,228,455 | B1 | 1/2016 | Belter et al. | |
| 2003/0066711 | A1 * | 4/2003 | Saiga | F01M 11/03 184/6.5 |
| 2009/0090315 | A1 * | 4/2009 | Uchida | F01L 1/024 123/53.6 |

* cited by examiner

*Primary Examiner* — Jacob M Amick
*Assistant Examiner* — Charles Brauch
(74) *Attorney, Agent, or Firm* — Andrus Intellectual Property Law, LLP

(57) ABSTRACT

An outboard motor includes an internal combustion engine having an engine block with vertically-aligned first and second banks of piston-cylinders that extend at an angle with respect to each other so as to form a V-shape. A crankshaft extends along a vertical axis. Combustion in the first and second banks of piston-cylinders causes rotation of the crankshaft. First and second camshafts extend along the first and second banks of vertically-aligned cylinders, respectively. A flexible coupler couples the crankshaft to the first and second camshafts so that rotation of the crankshaft causes rotation of the first and second camshafts. A rotary idler is coupled to the flexible coupler such that rotation of the crankshaft causes rotation of the rotary idler. A lubricating pump is coupled to the rotary idler such that rotation of the rotary idler causes the lubricating pump to pump lubricant to the internal combustion engine.

11 Claims, 6 Drawing Sheets

OUTBOARD MOTORS HAVING IDLER-DRIVEN LUBRICATING PUMP

FIELD

The present disclosure relates to outboard motors and more particularly to lubrication systems for outboard motors.

BACKGROUND

The following U.S. Patents are incorporated herein by reference:

U.S. Pat. No. 4,911,623 discloses a lubricating system for a rotary internal combustion engine that includes an oil supply chamber at one end of the rotorshaft to which lubricating oil is supplied by an engine driven oil pump. The oil is caused to flow from the chamber along the rotorshaft and into the interfaces between the various rotating engine components attached to the rotorshaft. In the preferred orientation of the engine with the rotorshaft vertically disposed, oil flow is primarily under the influence of gravity. Oil accumulating in a sump at the lower end of the rotorshaft is circulated to the combustion region of the rotor chamber, utilizing the inherent pressure differential there between, where it provides further engine lubrication and is eventually burned. Lubricating oil may also be picked up and circulated from the main supply dispersed along the rotorshaft by the circulating supply of cooling air through the engine, whereby it is transferred in the combustion air supplied to the carburetor.

U.S. Pat. No. 6,138,634 discloses an oil lubrication system for a marine outboard motor including an internal combustion engine. The oil lubrication system includes a series of oil passageways within the cylinder block of the internal combustion engine. The oil passageways are configured such that each cylinder in the internal combustion engine is supplied by its own oil passageway. Each of the oil passageways terminate in an outlet opening. The outlet opening is positioned within the cylinder block such that oil exiting the outlet opening is directed by the force of gravity into contact with a moving component of the internal combustion engine. As the internal components of the internal combustion engine move, oil contacting the components is physically distributed into contact with the bearings.

U.S. Pat. No. 6,460,504 discloses an oil lubrication circuit for an internal combustion engine in which first and second paths are located within a central bore of a camshaft. Liquid lubricant is directed from a gerotor pump to an oil filter and back toward numerous lubrication points of a crankshaft by utilizing the first and second paths which flow in opposite directions and which are both concentric with a central axis of rotation of the camshaft.

U.S. Pat. No. 9,228,455 discloses a marine engine for an outboard motor that comprises a bank of piston-cylinders, an intake camshaft that operates intake valves for controlling inflow of air to the bank of piston-cylinders, an exhaust camshaft that operates exhaust valves for controlling outflow of exhaust gas from the bank of piston-cylinders, and a cam phaser disposed on one of the intake camshaft and exhaust camshaft. The cam phaser is connected to and adjusts a timing of operation of the other of the intake camshaft and exhaust camshaft with respect to the one of the intake camshaft and exhaust camshaft.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain non-limiting examples disclosed herein, an outboard motor comprises an internal combustion engine having an engine block with vertically-aligned first and second banks of piston-cylinders that extend at an angle with respect to each other so as to form a V-shape. A crankshaft extends along a vertical axis. Combustion in the first and second banks of piston-cylinders causes rotation of the crankshaft. First and second camshafts extend along the first and second banks of cylinders, respectively. A flexible coupler couples the crankshaft to the first and second camshafts so that rotation of the crankshaft causes rotation of the first and second camshafts. A rotary idler is coupled to the flexible coupler such that rotation of the crankshaft causes rotation of the rotary idler. A lubricating pump is coupled to the rotary idler such that rotation of the rotary idler causes the lubricating pump to pump lubricant to the internal combustion engine.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
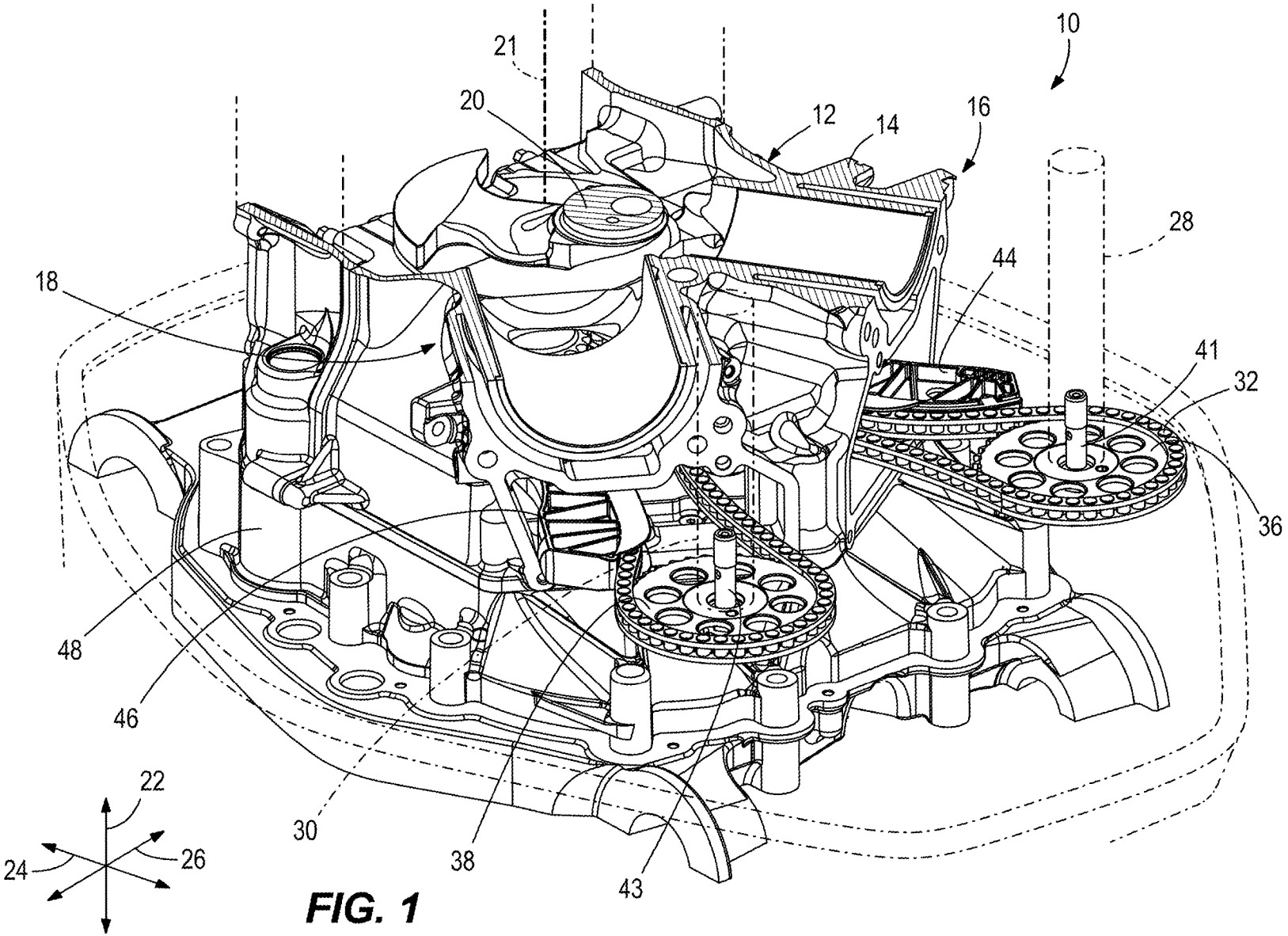
FIG. 1 is a perspective view looking down at a middle portion of an outboard motor, including a lower portion of an internal combustion engine, an upper surface of an adapter plate for supporting the internal combustion engine, and an upper portion of a lower cowling.
Figure 2:
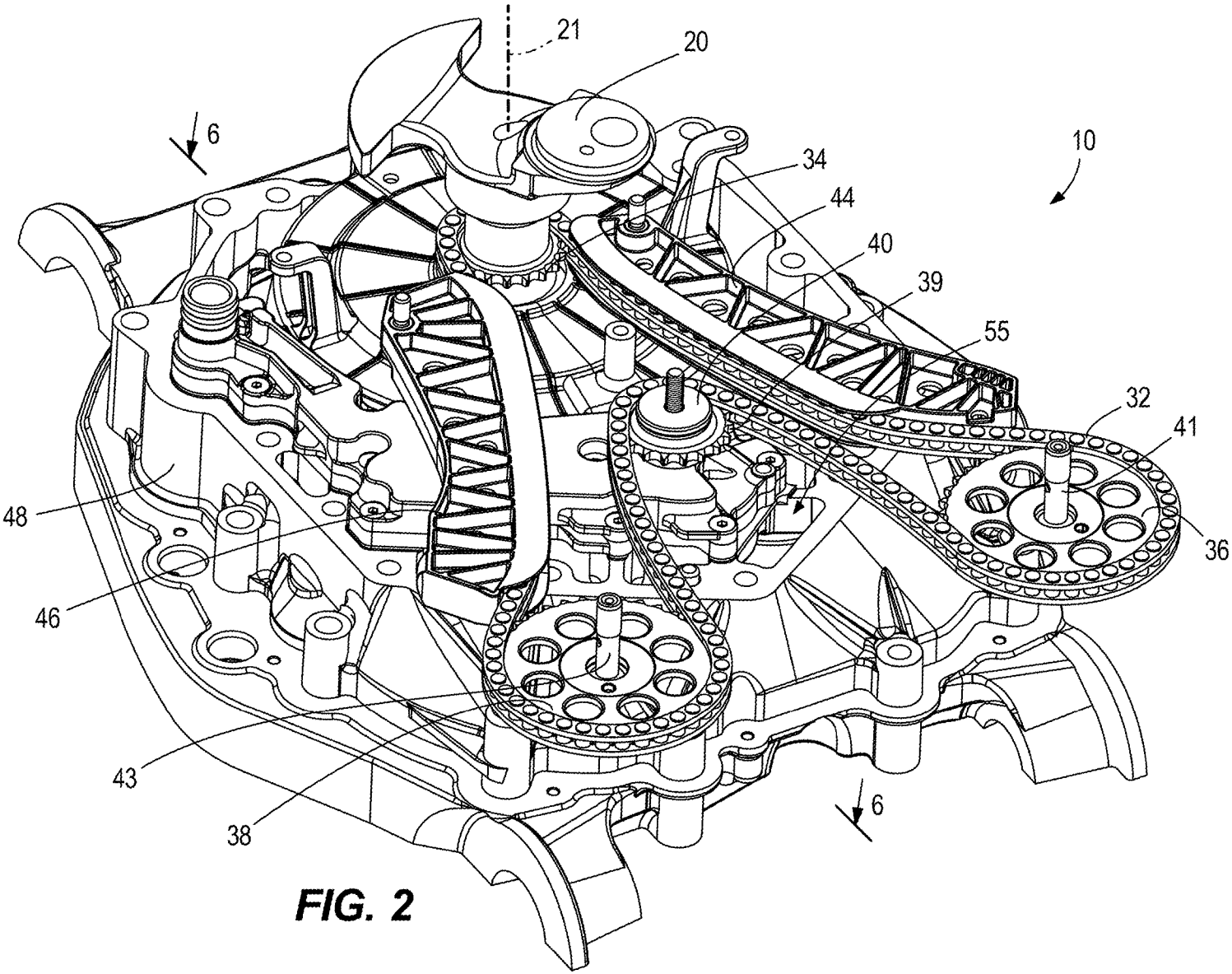
FIG. 2 is like FIG. 1 except the engine block of the internal combustion engine has been removed.

FIG. 1 depicts a portion of an outboard motor 10 for propelling a marine vessel in water. As is conventional, the outboard motor 10 includes an internal combustion engine 12 having an engine block 14, of which only a lower portion is shown. The engine block 14 has vertically-aligned first and second banks of piston-cylinders 16, 18 that extend at an angle with respect to each other so as to form a V-shape. Only the lower half of the lowermost piston-cylinders 16, 18 is shown. The number of piston-cylinders can vary, and together can for example form a conventional V-6 or V-8 configuration. The outboard motor 10 also has a crankshaft 20 that vertically extends along a crankshaft axis 21. Only the lower portion of the crankshaft 20 is shown. As is conventional, combustion in the first and second banks of piston-cylinders 16, 18 causes rotation of the crankshaft 20 about the crankshaft axis 21, which in turn causes rotation of a corresponding driveshaft 19 (see FIG. 5), a transmission, and a propeller shaft assembly. The figures do not depict upper portions of the outboard motor 10, including the upper portions of the engine block 14 and crankshaft 20, or lower portions of the outboard motor 10, including the lower end of the driveshaft 19, transmission, and propeller shaft assembly. However these items are conventional and well-known in the art and the particular configuration of these items can vary and is not critical to the present invention. Suitable examples are provided in the above-incorporated U.S. patents. As shown in FIG. 1, the internal combustion engine 12 vertically extends with respect to a vertical axis 22, horizontally extends with respect to a horizontal axis 24 that is perpendicular to the vertical axis 22, and laterally extends with respect to a lateral axis 26 that is perpendicular to the horizontal axis 24 and perpendicular to the vertical axis 22.

The outboard motor 10 further includes first and second camshafts 28, 30 that vertically extend along the first and second banks of piston-cylinders 16, 18. Referring now to FIGS. 1-4, a flexible coupler, which in this example is a chain 32 extends horizontally and laterally with respect to the outboard motor 10 and connects the crankshaft 20 to the first and second camshafts 28, 30 such that rotation of the crankshaft 20 causes rotation of the first and second camshafts 28, 30. The type and configuration of the flexible coupler could vary, and in other examples include a belt and/or the like. In the illustrated example, the crankshaft 20 includes a drive gear 34 that is engaged with the chain 32 such that rotation of the crankshaft 20 causes rotation of the drive gear 34, which in turn causes rotation of the chain 32. First and second driven gears 36, 38 are coupled to the lower ends of the first and second camshafts 28, 30, respectively. The chain 32 is also engaged with the first and second driven gears 36, 38 such that rotation of the chain 32 causes rotation of the first and second driven gears 36, 38, which in turn causes rotation of the first and second camshafts 28, 30. In the illustrated example, the first and second driven gears 36, 38 each rotate about respective center shafts 41, 43. The first and second camshafts 28, 30 are fixed to and rotate with the center shafts 41, 43. As is well known in the art, rotation of the first and second camshafts 28, 30 operates cams that control the intake air and/or exhaust gas valves on the internal combustion engine 12. Together these features are commonly referred to in the art as a timing chain and valve train. The type of connection between the first and second driven gears 36, 38 and the first and second camshafts 28, 30 can vary from what is shown. For example, the first and second driven gears 36, 38 can be incorporated into or formed with the first and second camshafts 28, 30.

A rotary idler 40 includes a driven gear 39 that is engaged with the chain 32 such that rotation of the chain 32 causes rotation of the rotary idler 40 about its own vertically-extending center shaft 42. In the illustrated example, the center shaft 42 is provided by a bolt that is engaged in a threaded connection with the bottom of the engine block 14. When viewed from above, the rotary idler 40 is located inside of the V-shape of the internal combustion engine 12, laterally between the first and second camshafts 28, 30 and horizontally between the crankshaft 20 and the first and second camshafts 28, 30. First and second chain guides 44, 46 are located horizontally between the crankshaft 20 and the first and second camshafts 28, 30. The first and second chain guides 44, 46 extend from the crankshaft 20 towards the first and second camshafts 28, 30, respectively, and provide a track that supports the noted rotational movement of the chain 32 during operation of the internal combustion engine 12.

An adapter plate 48 underlies the internal combustion engine 12. The adapter plate 48 is located vertically between the internal combustion engine 12 and a supporting cradle for supporting the outboard motor 10 with respect to a transom bracket for supporting the outboard motor 10 with respect to a marine vessel. The adapter plate 48 separates an outboard motor powerhead compartment in which the internal combustion engine 12 is located from a driveshaft housing through which the noted driveshaft extends towards the lower gearcase and propeller of the outboard motor 10. A lubrication sump 54 (see FIG. 5) is located in the lower midsection, below the adapter plate 48, and collects oil that drains by gravity from the internal combustion engine 12 past the adapter plate 48. In particular, the lubrication drains past the adapter plate 48 via lubrication drainage areas 55, shown in FIGS. 3 and 4.

Figure 3:
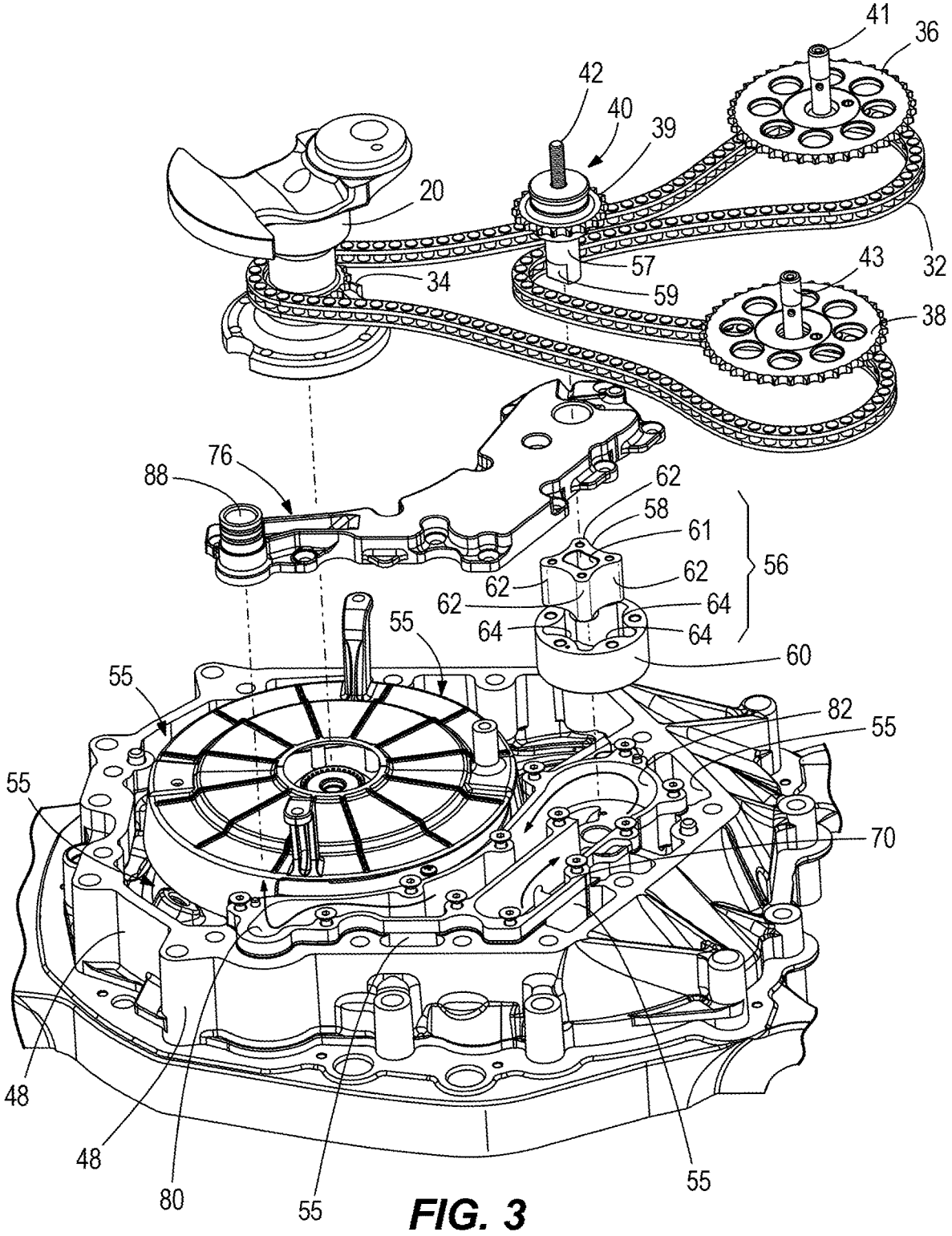
FIG. 3 is an exploded view of what is shown in FIG. 2.
Figure 4:
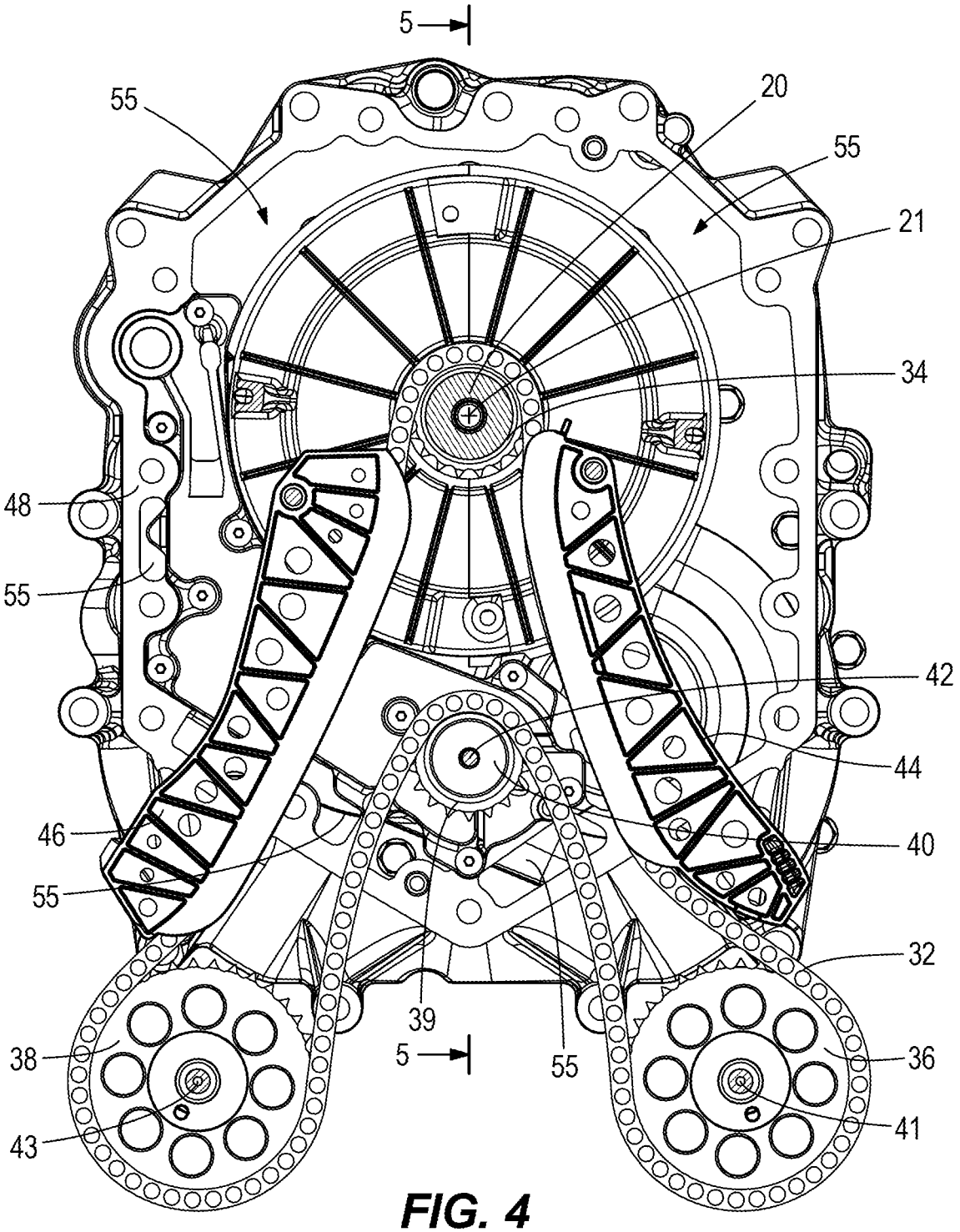
FIG. 4 is a top view of the adapter plate and a chain drive system for the internal combustion engine.
Figure 5:
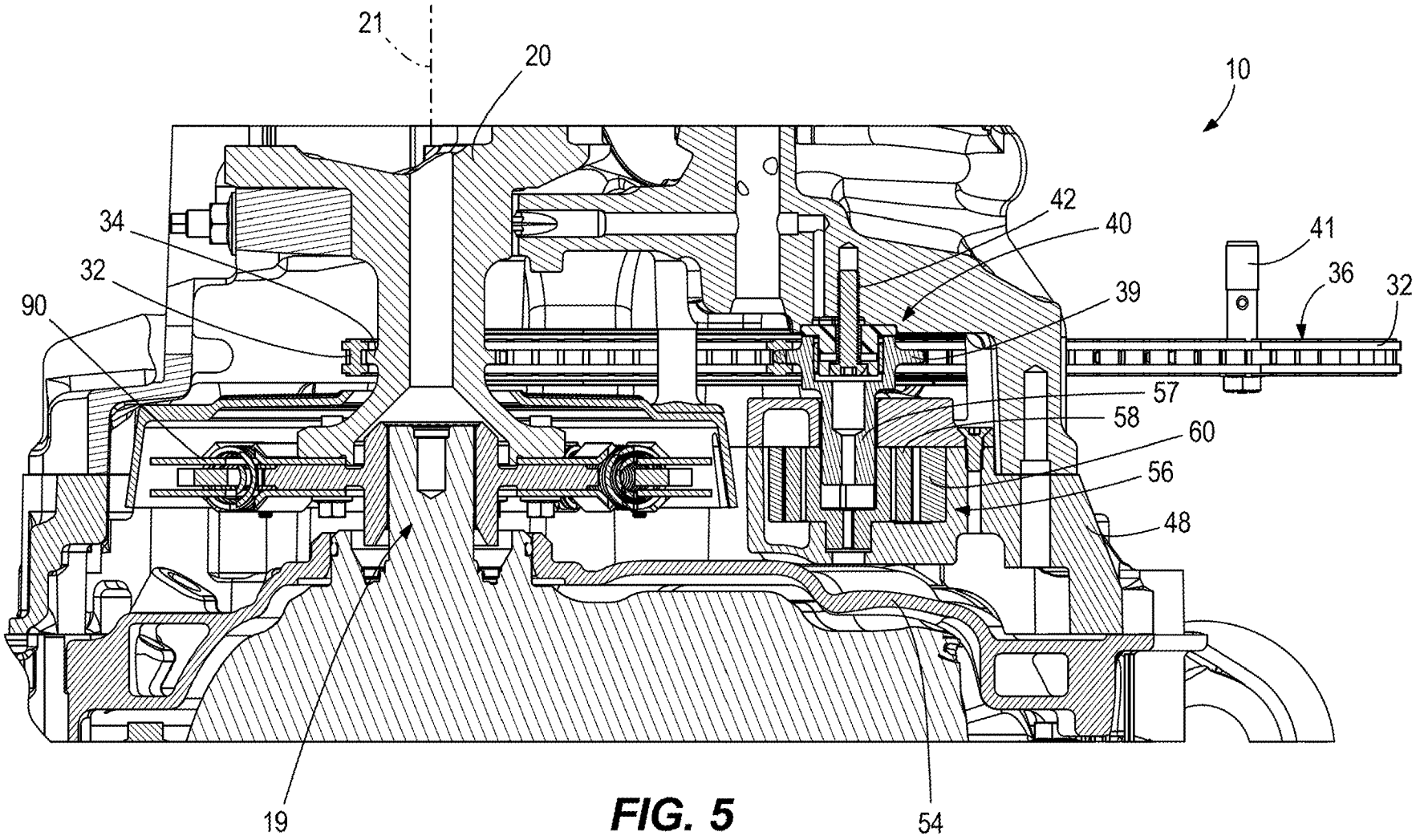
FIG. 5 is a view of section 5-5, taken in FIG. 4
Figure 6:
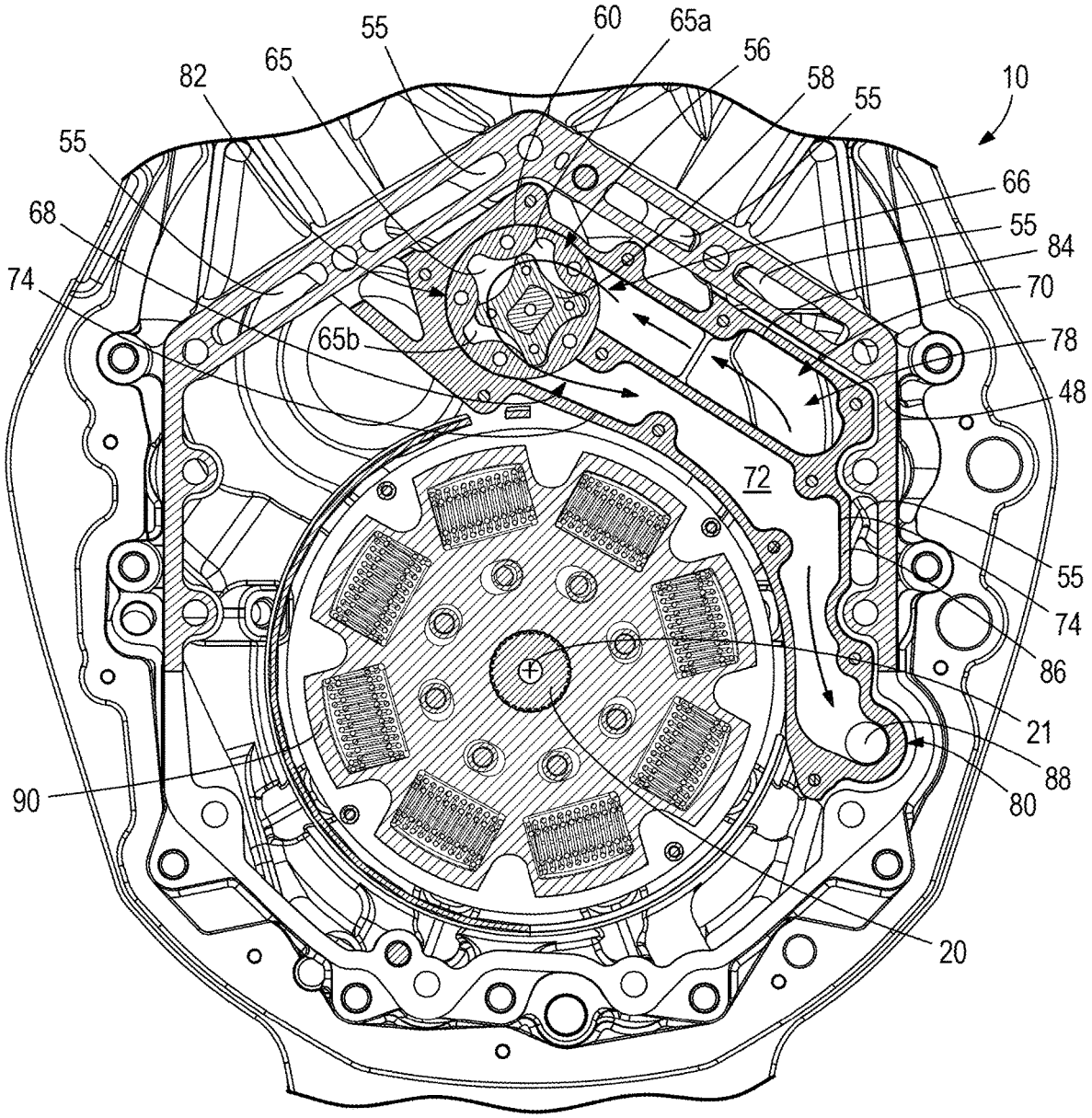
FIG. 6 is a view of section 6-6, taken in FIG. 2.

Referring now to FIGS. 3, 5 and 6, the outboard motor 10 has a lubricating pump 56 coupled to the rotary idler 40 such that rotation of the rotary idler 40 causes the lubricating pump 56 to pump lubricant from the sump 54 to the internal combustion engine 12. As shown in the figures, the lubricating pump 56 is located in the adapter plate 48, vertically below the rotary idler 40 and vertically lower than the first and second chain guides 44, 46. The particular configuration of the lubricating pump 56 can vary from what is shown. In the illustrated example, the lubricating pump 56 includes an inner rotor 58 that is keyed to the body of the rotary idler 40, so that as the rotary idler 40 rotates about the center shaft 42, the inner rotor 58 also rotates. In particular the body of the rotary idler 40 has an extension 57 that is coaxial with respect to the center shaft 42. The extension 57 has flats 59 and is engaged in a bore 61 in the inner rotor 58. The lubricating pump 56 further includes an outer rotor 60 in which the inner rotor 58 rotates. The inner rotor 58 has radially outwardly extending lobes 62 and the inwardly outer rotor 60 has radially extending lobes 64. As the rotary idler 40 rotates, the inner rotor 58 is caused to rotate which drives the outer rotor 60. This rotates the lobes 62 of the inner rotor 58 with respect to lobes 64 of the outer rotor 60, thus changing the shape and volume of gaps 65 there between (see FIG. 6). An increase in the volume creates a negative pressure or suction force that pulls the lubricant into an inlet 65*a* of the lubricating pump 56 and a decrease in volume creates a positive pressure that pumps the lubricant out of an outlet 65*b* of the lubricating pump 56, as shown by arrows in FIGS. 3 and 6. This type of pump is conventional and commonly referred to in the art as a gerotor pump and thus is not further described herein. The construction of the lubricating pump 56 can vary and suitable examples are commercially available from commercial sellers such as Melling, Nichols Portland, Mikuni, Pricol, and Fawer Pump, among others.

Referring to FIGS. 3 and 6, the lubricating pump 56 is disposed in an elongated cavity 70 formed in the adapter plate 48. The cavity 70 is defined by a floor 72, sidewalls 74, and a cover 76 (FIG. 3) that is attached to the adapter plate by fasteners, such as screws. The cavity 70 generally curves around a portion of the outer perimeter of the adapter plate 48 and extends from a first end 80 to a second end 82. The lubricating pump 56 is located at the second end 82 and draws lubricant from the underlying sump 54, as described above, via an inlet port 78 formed through the floor 72 proximate to the first end 80. As shown by arrows in FIGS. 3 and 6, the lubricant is drawn along a radially outer inlet passage 84 to the inlet 65*a*. The lubricant is pumped by the lubricating pump 56 into a radially inner outlet passage 68 to an outlet port 88 formed through the cover 76 at the second end 80. The outlet port 88 leads vertically upwardly to conventional lubrication passages in the internal combustion engine 12. Advantageously, the cover 76 can remain unsealed with respect to the adapter plate 48 since it is located in the lubrication drainage areas 55 through which the lubrication drains from the internal combustion engine 12 to the sump 54 below the adapter plate 48.

During research and experimentation, the present inventor has determined that it is desirable to provide an outboard motor having a shorter midsection, for example 20 inches. The inventor has also determined that it is desirable to achieve a shorter design with respect to the outboard motor 10 shown in the figures, including a torsional coupler 90 for balancing torque from the internal combustion engine 12 to the driveshaft 19 and transmission. The inventor further determined that it would be possible to couple the lubricating pump 56 to the rotary idler 40, at a location that is offset from the crankshaft axis 21 and vertically lower than the first and second chain guides 44, 46. Thus the torsional coupler 90 and the lubricating pump 56 can function side-by-side and on separate axes. Advantageously, in this configuration the lubrication pump 56 does not add to the overall vertical height of the midsection and primary drivetrain. This provides better overall packaging of the lubrication pump 56 and helps to provide an outboard motor 10 with the desired 20-inch midsection height. The present inventor also advantageously integrated the lubrication pump 56 into the adapter plate 48, which reduces overall part count and weight. The center shaft 42 of the rotary idler 40 rotates in an opposite direction compared to the crankshaft 20 and therefore the above-described porting for the lubricating pump 56 was designed accordingly. In the illustrated example, the inner rotor 58 rotates counter-clockwise when viewed from the top, as shown.

The present inventor also found it necessary to reduce the diameter of the lubricating pump 56 so that it could be powered by the rotary idler 40. This reduction in diameter required an increase in height of the rotors 58, 60 to achieve the necessary flow capacity of the lubricating pump 56. This was found to be beneficial because, as a result, the lubricating pump 56 has a smaller inner rotor tip speed that meets recommended speeds and is also directionally configured so as to reduce cavitation erosion. In addition, having the lubricating pump 56 nested in the adapter plate 48 and utilizing the center shaft 42 of the rotary idler 40 yields proper drive system alignment through common cylinder block assembly machined datum features. Location of the lubricating pump 56 internal to the lubrication drainage areas 55 also advantageously eliminates the need for seals between the adapter plate 48 and cover 76.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. An outboard motor comprising:

an internal combustion engine having an engine block with vertically-aligned first and second banks of piston-cylinders that extend at an angle with respect to each other so as to form a V-shape;

a crankshaft that extends along a vertical axis, wherein combustion in the first and second banks of piston-cylinders causes rotation of the crankshaft;

first and second camshafts that extend along the first and second banks of cylinders, respectively;

a flexible coupler that couples the crankshaft to the first and second camshafts so that said rotation of the crankshaft causes rotation of the first and second camshafts;

a rotary idler coupled to the flexible coupler such that said rotation of the crankshaft causes rotation of the rotary idler; and a lubricating pump coupled to the rotary idler such that said rotation of the rotary idler causes the lubricating pump to pump lubricant to the internal combustion engine, wherein the rotary idler has a center shaft about which the rotary idler rotates, wherein the lubricating pump comprises a rotor that rotates with the center shaft, and wherein the lubricating pump is located vertically below the rotary idler;

an adapter plate separating the internal combustion engine from an underlying lubrication sump, wherein the lubricating pump is located at least partially in the adapter plate;

a cover enclosing the lubricating pump in the adapter plate;

wherein the lubricating pump comprises a rotor, and wherein the cover and the adapter plate together define a cavity for the rotor; and an inlet that conveys lubrication to the cavity under suction force from the lubricating pump and an outlet that delivers lubrication from the cavity under pumping force from the lubricating pump.

2. The outboard motor according to claim 1, wherein the internal combustion engine vertically extends with respect to the vertical axis, horizontally extends with respect to a horizontal axis that is perpendicular to the vertical axis, and laterally extends with respect to a lateral axis that is perpendicular to the horizontal axis and perpendicular to the vertical axis, and wherein the rotary idler is located laterally between the first and second camshafts.

3. The outboard motor according to claim 2, wherein the lubricating pump is located horizontally between the crankshaft and each of the first and second camshafts.

4. The outboard motor according to claim 1, wherein the internal combustion engine vertically extends with respect to the vertical axis, horizontally extends with respect to a horizontal axis that is perpendicular to the vertical axis, and laterally extends with respect to a lateral axis that is perpendicular to the horizontal axis and perpendicular to the vertical axis, and wherein the rotary idler is located horizontally between the crankshaft and each of the first and second camshafts.

5. The outboard motor according to claim 4, wherein the rotary idler is located laterally between the first and second camshafts.

6. The outboard motor according to claim 1, wherein the cover is unsealed with respect to the adapter plate, and wherein the lubricating pump is disposed in a lubrication drainage area through which lubrication drains by gravity from the internal combustion engine to the lubrication sump.

7. The outboard motor according to claim 1, wherein the flexible coupler comprises a chain and wherein rotary idler comprises a gear that is coupled to the chain such that movement of the chain causes rotation of the rotary idler.

8. The outboard motor according to claim 7, further comprising at least one chain guide that supports the chain between the crankshaft and at least one of the first and second camshafts.

9. The outboard motor according to claim 8, wherein the lubricating pump is located vertically below the at least one chain guide.

10. The outboard motor according to claim 9, wherein the at least one chain guide is one of first and second chain guides that are located between the crankshaft and the first and second camshafts, respectively, and wherein the lubricating pump is located between the first and second chain guides.

11. The outboard motor according to claim 1, wherein the cavity is entirely defined by sidewalls having a smooth contour.

* * * * *